US009657948B2

(12) United States Patent
Vogtmann

(10) Patent No.: US 9,657,948 B2
(45) Date of Patent: May 23, 2017

(54) RETAINING ELEMENT FOR RETAINING A HEAT SHIELD TILE AND METHOD FOR COOLING THE SUPPORTING STRUCTURE OF A HEAT SHIELD

(71) Applicant: SIEMENS AKTIENGESELLSCHAFT, München (DE)

(72) Inventor: Daniel Vogtmann, Düsseldorf (DE)

(73) Assignee: SIEMENS AKTIENGESELLSCHAFT (DE)

( * ) Notice: Subject to any disclaimer, the term of this patent is extended or adjusted under 35 U.S.C. 154(b) by 248 days.

(21) Appl. No.: 14/430,156

(22) PCT Filed: Sep. 17, 2013

(86) PCT No.: PCT/EP2013/069271
§ 371 (c)(1),
(2) Date: Mar. 20, 2015

(87) PCT Pub. No.: WO2014/044673
PCT Pub. Date: Mar. 27, 2014

(65) Prior Publication Data

US 2015/0247640 A1 Sep. 3, 2015

(30) Foreign Application Priority Data

Sep. 21, 2012 (EP) ..... 12185430

(51) Int. Cl.
*F23R 3/00* (2006.01)
*F23M 5/04* (2006.01)
(Continued)

(52) U.S. Cl.
CPC ..... *F23R 3/005* (2013.01); *F23M 5/04* (2013.01); *F23M 5/085* (2013.01); *F23R 3/002* (2013.01); *F23R 3/007* (2013.01); *F23R 3/60* (2013.01)

(58) Field of Classification Search
CPC .. F23M 5/04; F23M 5/085; F23R 3/60; F23R 3/002; F23R 2900/03042;
(Continued)

(56) References Cited

U.S. PATENT DOCUMENTS 4,820,097 A * 4/1989 Maeda ..... F02K 1/80 165/134.1
5,083,424 A * 1/1992 Becker ..... F23R 3/007 110/336
(Continued)

FOREIGN PATENT DOCUMENTS

CN 1502797 A 6/2004
EP 1 489 245 A1 12/2004
(Continued)

OTHER PUBLICATIONS

International Search Report dated Apr. 1, 2014 issued in corresponding International patent application No. PCT/EP2013/069271.
(Continued)

*Primary Examiner* — Gerald L Sung
*Assistant Examiner* — Stefan Ibroni
(74) *Attorney, Agent, or Firm* — Ostrolenk Faber LLP

(57) ABSTRACT

A retaining element (22, 54) for retaining a heat shield tile on a supporting structure: A fastening section (23) fastened to the supporting structure. A retaining section (24) having a retaining head (25), which engages an engagement device on the heat shield tile. The fastening section (23) top side (28) faces the cold side of the heat shield tile when the retaining section engages the heat shield tile. Scaling of the
(Continued)

supporting structure due to the entry of hot gas can be avoided particularly effectively by means of the retaining element. At least one cooling-air passage (34, 55) arranged in the fastening section (23) has an inlet opening (35, 68) and at least one outlet opening (37, 38, 62) which is arranged in a lateral surface (32) and/or on the top side (28) of the fastening section. Cooling air, which enters the inlet opening (35, 68) and exits from the at least one outlet opening, can be conducted in a respective outflow direction (50, 51, 59, 63, 61) by the cooling-air passage, which outflow is parallel to the cold side and avoids impingement cooling of the heat shield tile. The fastening section is arranged on the supporting structure such that the cooling-air passage (34, 55) corresponds to at least one cooling-air channel (45) in the supporting structure.

13 Claims, 3 Drawing Sheets

(51) Int. Cl.
*F23M 5/08* (2006.01)
*F23R 3/60* (2006.01)

(58) Field of Classification Search
CPC .. F23R 2900/03041; F23R 2900/00017; F16B 35/00; F16B 21/09
See application file for complete search history.

(56) References Cited

U.S. PATENT DOCUMENTS

| | | | | |
|---|---|---|---|---|
| 5,431,020 | A * | 7/1995 | Maghon | E04F 13/0846 403/179 |
| 6,711,899 | B2 * | 3/2004 | Bast | F23M 5/02 110/336 |
| 7,779,637 | B2 * | 8/2010 | Heilos | F23M 5/04 60/752 |
| 8,104,287 | B2 * | 1/2012 | Fischer | F23M 5/04 60/752 |
| 8,800,292 | B2 * | 8/2014 | Bottcher | F23M 5/04 60/752 |
| 2003/0221429 | A1 | 12/2003 | Laing et al. | 60/740 |
| 2004/0074188 | A1 | 4/2004 | Beck et al. | |
| 2006/0255549 | A1 | 11/2006 | Amos et al. | |
| 2009/0202956 | A1 | 8/2009 | Tschirren et al. | |

FOREIGN PATENT DOCUMENTS

| | | |
|---|---|---|
| EP | 1 701 095 A1 | 9/2006 |
| EP | 2 270 395 A1 | 1/2011 |

OTHER PUBLICATIONS

International Preliminary Report on Patentability dated Sep. 15, 2014 issued in corresponding International patent application No. PCT/EP2013/069271.

* cited by examiner

RETAINING ELEMENT FOR RETAINING A HEAT SHIELD TILE AND METHOD FOR COOLING THE SUPPORTING STRUCTURE OF A HEAT SHIELD

CROSS-REFERENCE TO RELATED APPLICATIONS

The present application is a 35 U.S.C. §§371 national phase conversion of PCT/EP2013/069271, filed Sep. 17, 2013, which claims priority of European Patent Application No. 12185430.1, filed Sep. 21, 2012, the contents of which are incorporated by reference herein. The PCT International Application was published in the German language.

TECHNICAL FIELD

The invention relates to a retaining element for retention of a heat shield tile, which is retained on a support structure, and to a method for cooling the support structure of a heat shield. The invention also relates to such a heat shield and also to a combustion chamber which is lined by the heat shield, and to a gas turbine with the heat shield.

TECHNICAL BACKGROUND

Heat shields, which have to withstand hot gases of 1000 to 1600 degrees Celsius, are used in many technical applications. Particularly gas turbines, as are used in power-generating power stations and in aircraft engines, have correspondingly large surfaces inside the combustion chambers which have to be shielded by means of heat shields. Owing to the thermal expansion and owing to large dimensions, the heat shield is assembled from a large number of individual, generally ceramic, heat shield tiles which are fastened on a support structure, and neighboring tiles are spaced apart with a sufficient gap.

This gap provides the heat shield elements with sufficient room for thermal expansion. Since, however, the gap also enables direct contact of the hot combustion gases with the metal support structure and the retaining elements of the heat shield tiles, cooling air is injected through the gaps in the direction of the combustion chamber as a countermeasure.

A generic-type heat shield therefore comprises a support structure and a number of heat shield tiles which are detachably fastened on the support structure by means of retaining elements, wherein each heat shield tile has a cold side facing the support structure and a hot side which lies opposite the cold side and can be acted upon by a hot medium. For protection against hot gases, at least one cooling air passage is provided in the support structure.

The generic-type retaining element has a fastening section which is fastened on the support structure and a retaining section with a retaining head which is configured for engaging in an engagement device provided on the heat shield tile. With the fastening section fastened on the support structure and the retaining section engaging the heat shield tile, the fastening section has an upper side which faces a cold side of the heat shield tile.

EP 1 701 095 A1 discloses a heat shield, referred to in the introduction, of a combustion chamber of a gas turbine with a support structure and a number of heat shield tiles which are detachably arranged on the support structure. For protection of the combustion chamber wall, the heat shield tiles are arranged in an extensively covering manner on the support structure, leaving expansion gaps, wherein each heat shield tile has a cold side facing the support structure and a hot side which lies opposite the cold side and can be acted upon by a hot medium. The heat shield tiles are fastened on the support structure in a sprung manner by means of two metal retaining elements in each case. To this end, each retaining element comprises a retaining section, with an engagement section, and a fastening section. Retaining grooves are introduced into each heat shield tile on two opposite circumferential sides so that for retention of the heat shield tile the engagement sections of the retaining elements can oppositely engage in the retaining grooves. The retaining elements which are oppositely fastened on the heat shield tile in this way are guided by their fastening section in a fastening groove, extending beneath the heat shield tile, in the support structure. For protection against hot gases, the engagement sections of the metal tile holders are cooled. To this end, openings are introduced into the tile holders in the region of the retaining section and into the retaining latch of the heat shield tiles, which openings align with a cooling air hole which is arranged in the support structure so that cooling air from the cooling air hole, flowing in a direct line, impinges upon a cold side of the engagement section.

Despite this cooling of the engagement sections according to the prior art, with hot gas acting upon the heat shield, entry of hot gas in the region of the expansion gaps between the heat shield tiles can occur. The hot gas can then spread beneath the heat shield tiles and lead to scaling of the support structure.

SUMMARY OF THE INVENTION

It is therefore the object of the present invention to provide a retaining element for a heat shield tile which is retained on a support structure, a heat shield with a support structure, and a method for cooling the support structure, by means of which scaling of the support structure on account of hot gas entry can be avoided in a particularly effective manner.

It is a further object of the invention to provide a combustion chamber and a gas turbine, such that scaling of the support structure of a heat shield incorporated in the combustion chamber can be avoided in a particularly effective manner.

The object is achieved according to the invention with a retaining element of the type referred to in the introduction by at least one cooling air passage being arranged in the fastening section. The cooling air passage comprises an inlet opening and at least one discharge opening which is arranged in a lateral face and/or on the upper side of the fastening section. Cooling air entering the inlet opening discharges from the at least one discharge opening, wherein an outflow direction can be impressed in each case upon the cooling air by means of the cooling air passage, which outflow direction comprises a velocity component parallel to the cold side and avoids impingement cooling of the heat shield tile which is retained by the retaining section. The fastening section can be arranged on the support structure for this purpose in such a way that the cooling air passage communicates with at least one cooling air channel which is arranged in the support structure.

The embodiment according to the invention of the retaining element enables cooling air to be fed in the region of the fastening section and beneath a tile of a heat shield. On account of this cooling air, which in the main flows in centrally beneath the heat shield tile, the support structure can be effectively cooled in the regions which serve for the fastening of the heat shield tiles. The sprung retaining elements, which are also referred to as tile holders, may be fastened in the main centrally beneath the heat shield tiles. By means of the invention, this region is effectively cooled, wherein a direct flow onto the heat shield tiles is prevented by means of the tile holders which are designed according to the invention. Damage to the heat shield tiles is therefore reliably avoided.

The heat shield tiles are generally comprised of ceramic material. During operation, their hot sides are in direct contact with the hot gases in the combustion chamber. Impingement cooling of the heat shield tiles from their cold sides could lead to thermally induced stresses in the heat shield tiles and therefore to increased development of cracks in the tiles.

According to the invention, with suitable positioning of the tile holder on the support structure, the cooling air passage integrated into the fastening section can be fed by means of at least one cooling air channel in the support structure. The fact that the cooling air passage communicates with the cooling air channel is to be understood that the tile holder can be positioned on the support structure in such a way that cooling air flowing out of the cooling air channel at least partially enters the inlet opening of the cooling air passage.

In this position, the inlet opening of the cooling air passage and the discharge opening of the cooling air channel can be aligned with each other, for example. Therefore, a physically fixed connection between the cooling air channel in the support structure and the cooling air passage in the tile holder need not exist. The tile holder or retaining element may be positioned at a suitable point on the support structure, for enabling simple installation or removal of the heat shield tiles for maintenance purposes. For example, the retaining elements or tile holders can be guided in fastening grooves, wherein the cooling air channels which are arranged in the support structure are arranged in a bottom of the fastening groove.

The tile holders in this case can be slid across the cooling air channels for maintenance purposes. The cooling air passage can, for example, be arranged in the end region of the fastening section facing away from the retaining section. The flow direction of the cooling air, when leaving a discharge opening of the cooling air passage, can be directed onto a region of the support structure which is to be cooled by a corresponding design of the cooling air passage. The direction of the overall impulse of a cooling air flow discharging from a discharge opening of the cooling air passage is in this case not directed onto the heat shield. In this respect, the respective outflow direction has a velocity component which extends parallel to the cold side of the heat shield tile and avoids impingement cooling of the heat shield tile.

According to an advantageous embodiment, the cooling air passage communicates with a projection which is formed on the upper side of the fastening section and extends longitudinally away from that section. This embodiment enables the at least one discharge opening of the cooling air passage to be arranged to discharge laterally in the projection.

It can also be seen to be advantageous for the fastening section to be thickened in the region of the projection.

Since by this thickening more material is made available, the cooling air passage can be arranged, for example, inside the fastening section, for example in the form of a cooling air hole which is arranged in the fastening section and comprises at least one discharge opening which is arranged in a lateral face of the extended projection. The cooling air hole can have a T-shaped course, for example.

According to an embodiment of the invention, the fastening section is offset in a step-like manner in the region of the projection. According to this embodiment, the cooling air passage can be formed as a groove which is arranged beneath the step. The groove can have two opposite lateral faces. The groove could also comprise only one lateral face, however. The cooling air passage therefore comprises two outlet openings which are arranged in one lateral face of the fastening section. The cooling air passage can comprise additional discharge openings which are arranged in the projection.

The projection is advantageously of stepped design and comprises at least one lateral face which points in the direction of the retaining section. According to this development of the invention, at least one discharge opening of the cooling air passage is arranged in this lateral face.

In this way, regions of the support structure on which the fastening section is retained can be cooled in particularly effective manner. To this end, by means of a corresponding design of the cooling air passage, the flow direction of the cooling air discharging from the cooling air passage can be directed onto the lateral edges of the fastening section.

Furthermore, it can be advantageously provided that the fastening section comprises an elongate baseplate. One end face of the fastening section adjoins the retaining section. On the other end face of the fastening section, a blocking plate is arranged in an offset manner in relation to the baseplate and in the direction of the heat shield tile. Therefore, the blocking plate forms a step-like projection in the upper side of the fastening section. In this case, the cooling air passage is delimited at least by the underside of the blocking plate and the portion of the end face of the baseplate extending beneath the blocking plate.

This embodiment of the invention features a particularly simple construction. The retaining element according to the invention could, for example, be realized by fastening a blocking plate on the surface of a conventional fastening section.

It is a further object of the invention to disclose a heat shield referred to in the introduction by means of which scaling of the support structure on account of entry of hot gas can be avoided in a particularly effective manner.

To this end, at least one retaining element incorporated in the heat shield is designed according to the present disclosure. At least one cooling air channel which is arranged in the support structure communicates with the retaining element so that with heat shield tiles fastened on the support structure, cooling air flowing from the cooling air channel at least partially enters the inlet opening of the cooling air passage.

The fact that a cooling air channel which is arranged in the support structure communicates with the retaining element is to be understood in such a way that the retaining element can be positioned by its fastening section on the support structure in such a way that the cooling air flowing from the cooling air channel at least partially enters the inlet opening of the cooling air passage.

It is also an object of the invention to provide a combustion chamber referred to in the introduction and a gas turbine referred to in the introduction with at least one combustion chamber, and by means of which scaling of the support structure on account of entry of hot gas can be avoided in a particularly effective manner.

It is also an object of the invention to provide a method for cooling the support structure of a heat shield, by means of which scaling of the support structure on account of entry of hot gas can be avoided in a particularly effective manner.

The heat shield used in the method comprises a number of heat shield tiles which are detachably fastened on the support structure. The heat shield tiles are fastened on the support structure by means of retaining elements.

For achieving the object, cooling air is directed from the support structure along a cooling air passage, which is formed by the fastening section of a retaining element, to at least an upper side and/or lateral face of the fastening section. A flow direction is impressed upon the cooling air in the process by means of the cooling air passage, which flow direction avoids impingement cooling of the heat shield tile.

The fact that a flow direction is impressed upon the cooling air is to be understood in such a way that the cooling air discharges from one or more discharge openings of the cooling air passage. Each of these cooling air flows, when discharging, has an overall impulse which may selectively point in different directions. Common to this, however, is that impingement cooling of the heat shield is avoided. Such an overall impulse therefore always has a velocity component which is parallel to the cold side of the heat shield tile and is not directed directly onto this side.

The cooling air, when discharging from the cooling air passage, is advantageously directed onto at least one region of the support structure on which is fastened a fastening section of a retaining element.

It can especially be provided that the cooling air flowing along the cooling air passage is directed onto an edge of a fastening groove.

To this end, the course of the cooling air passage is correspondingly formed.

Further expedient embodiments and advantages of the invention are the subject matter of the description of exemplary embodiments of the invention with reference to the figure of the drawing, wherein the same designations refer to similarly functioning components.

DESCRIPTION OF EMBODIMENTS

Figure 1:
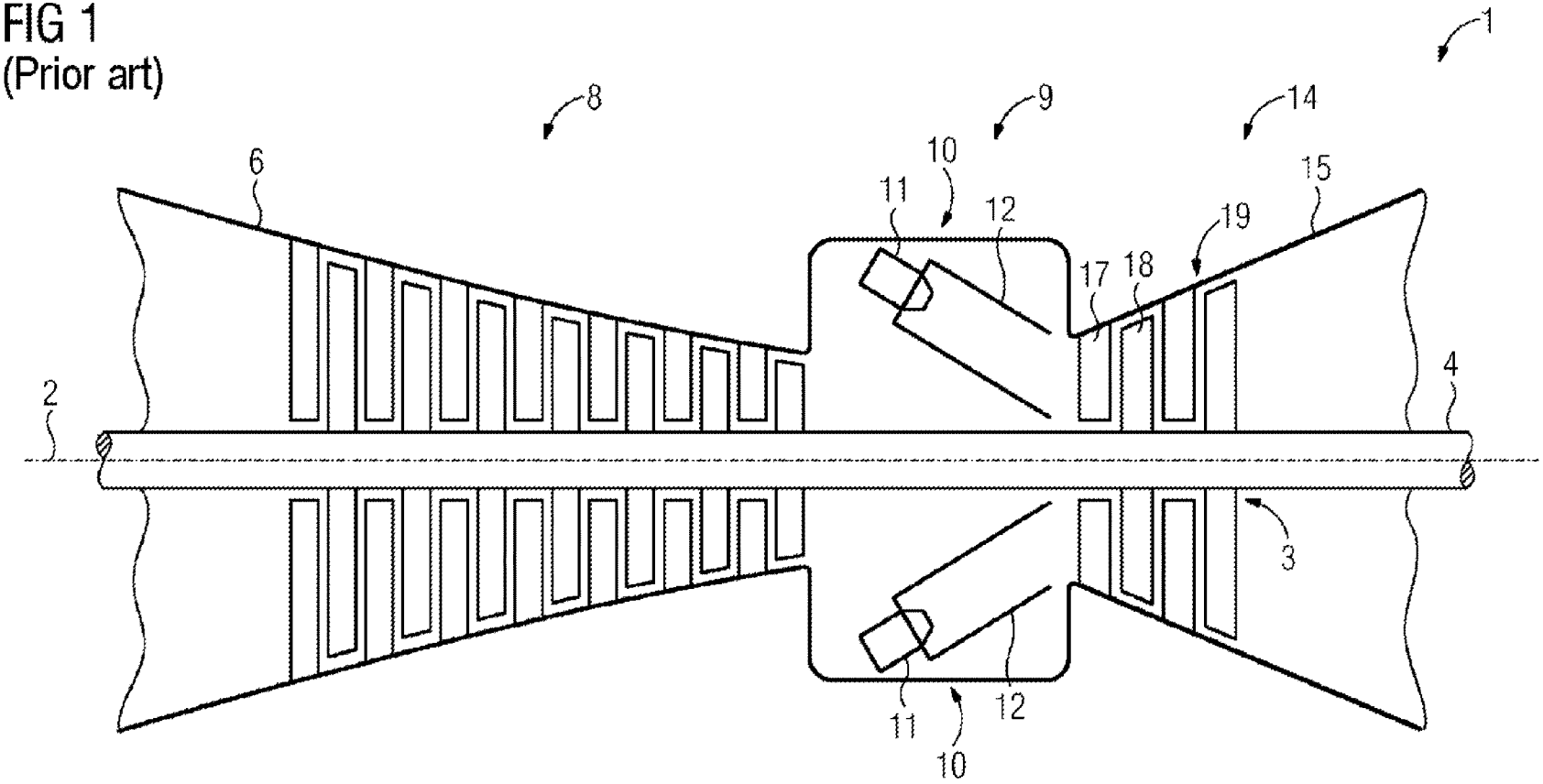
FIG 1 (Prior art)
FIG. 1 shows a schematic view of a gas turbine according to the prior art.

FIG. 1 shows a schematic sectional view of a gas turbine 1 according to the prior art. Inside, the gas turbine 1 is a rotor 3, rotatably mounted around a rotational axis 2, with a shaft 4, which together are also referred to as a turbine rotating component. There are arranged in sequence along the rotor 3 an intake housing 6, a compressor 8, a combustion system 9 including a plurality of combustion chambers 10 which comprise in each case a combustion arrangement 11 and a housing 12, a turbine 14 and an exhaust gas housing 15. The housing 12 is lined with a heat shield (not shown) for protection against hot gases.

The combustion system 9 communicates with, for example an annular hot gas passage. A plurality of series-connected turbine stages form the turbine 14 there. Each turbine stage is formed from blade rings. A row formed from rotor blades 18 follows a row formed from stator blades 17 in the hot gas passage, as seen in the flow direction of a working medium. The stator blades 17 in this case are fastened on an inner housing of a stator 19, whereas the rotor blades 18 of a row are attached on the rotor 3 by means of a turbine disk, for example. A generator (not shown), for example, may be coupled to the rotor 3.

During operation of the gas turbine, air is drawn in by the compressor 8 through the intake housing 6 and is compressed. The compressed air which is made available at the turbine-side end of the compressor 8 is directed to the combustion system 9 and in the region of the combustion arrangement 11 is mixed with fuel there. The mixture is then combusted with the aid of the combustion arrangement 11, forming a working gas flow in the combustion system 9. From there, the working gas flow flows along the hot gas passage past the stator blades 17 and the rotor blades 18. On the rotor blades 18, the working gas flow expands, transmitting an impulse so that the rotor blades 18 drive the rotor 3 and this drives the generator (not shown) which is coupled to it.

Figure 2:
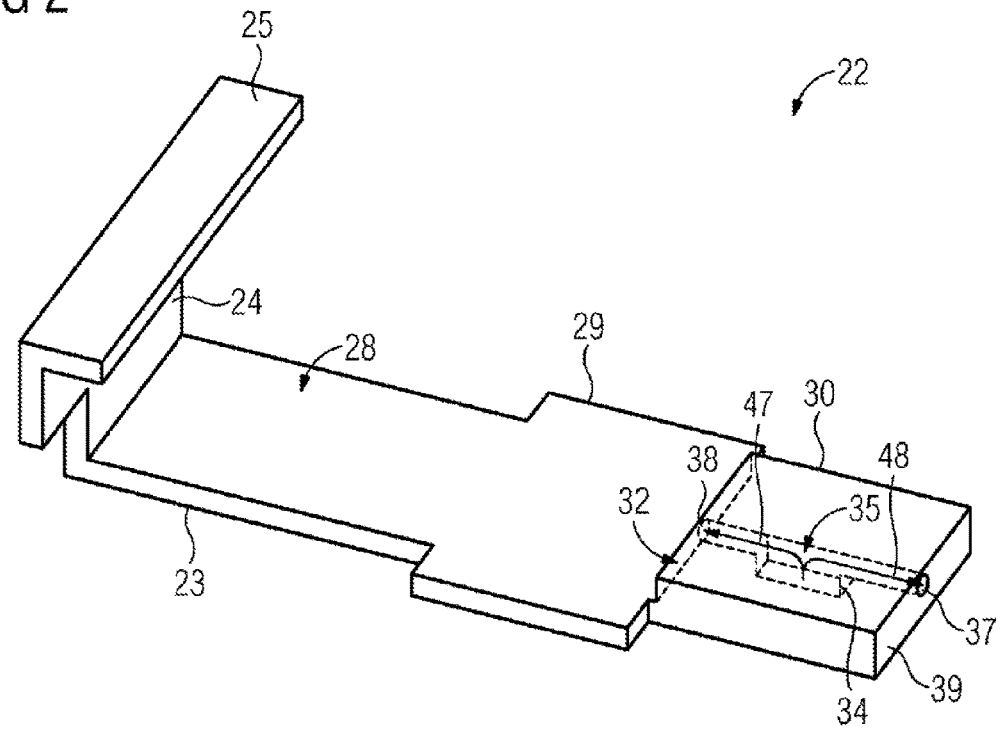
FIG. 2 shows a perspective, schematic view of a retaining element according to the invention according to a first exemplary embodiment.
Figure 6:
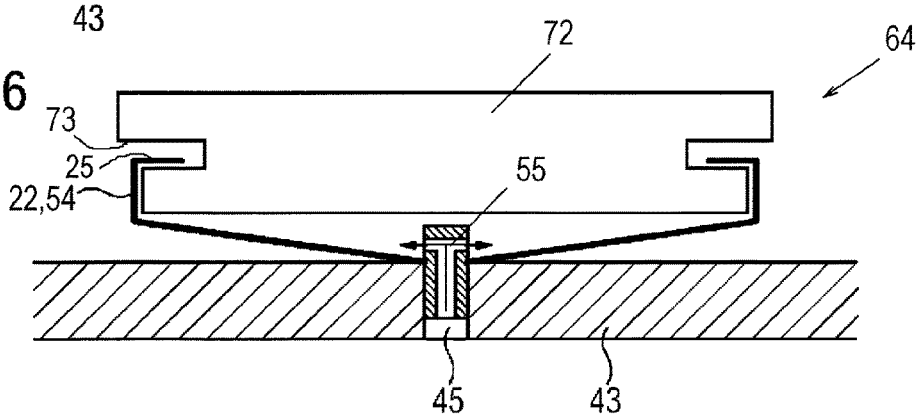
FIG. 6 shows a heat shield as held in the retaining element in FIG. 5.

FIG. 2 shows a retaining element 22 according to the invention according to a first exemplary embodiment in a perspective view. The exemplary embodiment of the retaining element 22 comprises a rectangular, plate-like fastening section 23, adjoining one end face of which at right angles is a retaining section 24. The retaining section 24 comprises a retaining head 25 which is designed for engaging an engagement device such as a peripheral groove 73 provided on the heat shield tile 72 (FIG. 6). The fastening section 23 has an upper side 28. For fastening the retaining element 22 on a support structure (not shown), the fastening section 23 is widened in certain sections. This widening of the fastening section 23 is also referred to as a shoe 29.

A projection 30, arranged on the upper side 28 of the fastening section 23 and projecting away from the retaining section, adjoins the shoe 29 so that the fastening section is thickened in the region of the projection 30. The projection 30 is of a step-like design, with one lateral face 32 pointing in the direction of the retaining section 24. Within the scope of the invention, the term "lateral face of the fastening section 23" also includes the lateral face 32.

The depicted fastening section 23 comprises a cooling air passage which extends through the thickened region of the fastening section 23. The cooling air passage 34 therefore communicates with the projection 30 which is formed on the upper side of the fastening section. The cooling air passage 34 comprises an inlet opening 35 and two discharge openings 37 and 38. The discharge openings 37, 38 are arranged in opposite lateral faces 32, 39 of the fastening section. The depicted cooling air passage 34 is a cooling air hole which has a discharge opening 38 arranged in the lateral face 32 of the projection 30 pointing in the direction of the retaining section 24 and a discharge opening 37 arranged in the opposite lateral face 39.

A cooling air flow, which enters the cooling air passage 34 through the inlet opening 35, is split into two flows as a result of the course of the T-shaped cooling air passage 34 and discharges from the cooling air passage 34 through the discharge openings 37 and 38. During the throughflow of the cooling air passage 34, an outflow direction, which extends parallel to the upper side of the fastening section 23, is impressed upon the cooling air. An impingement cooling of structures (not shown) which are arranged above the retaining element 22 is avoided as a result of this.

Figure 3:
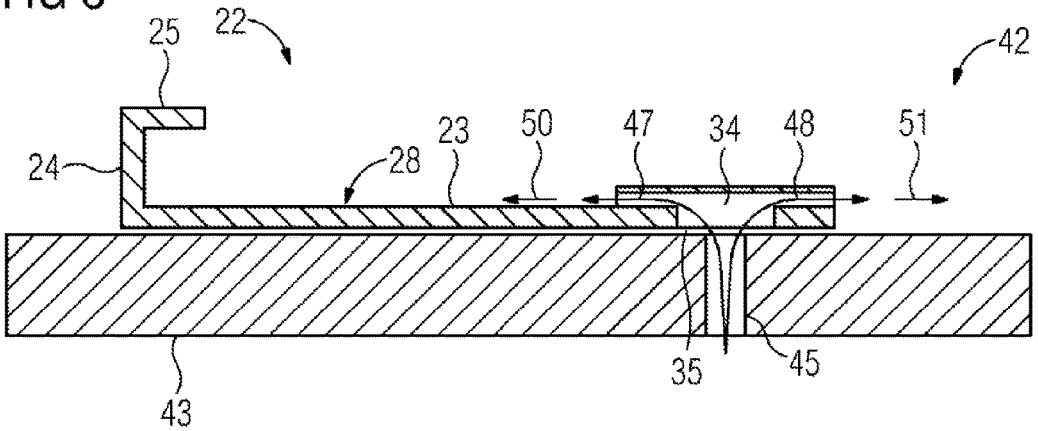
FIG. 3 shows a sectional view of the retaining element shown in FIG. 2 arranged on a support structure of heat shield according to the invention.

FIG. 3 shows a detail of a heat shield 42 according to the invention with a support structure 43 below and a retaining element 22 which is fastened on the support structure and designed according to FIG. 2. The retaining element 22, by its fastening section 23, butts against the support structure 43 and has a retaining section 24 for retention of a heat shield tile (not shown). In this position, the upper side 28 of the fastening section 23 faces a cold side of a heat shield tile (not shown) which is retained by the retaining section 24.

In the depicted sectional view, the cooling air passage 34, which is described in more detail in connection with FIG. 2, is shown in a longitudinal section. The inlet opening 35 of the cooling air passage 34 aligns with a cooling air channel 45 which is arranged in the support structure. Therefore, the fastening section 23 is arranged on the support structure 43 in such a way that the cooling air passage 34 communicates with a cooling air channel 45 which is arranged in the support structure 43. In the figure, two flow paths 47 and 48, along which some of the cooling air flowing from the cooling air channel 45 passes through the cooling air passage 34, are sketched in by way of example. Outflow directions 50 and 51 are impressed upon the cooling air by means of the cooling air passage 34 and comprises a velocity component which is parallel to the cold side of a heat shield tile retained by the retaining element and avoids an impingement cooling of the heat shield tile.

Figure 4:
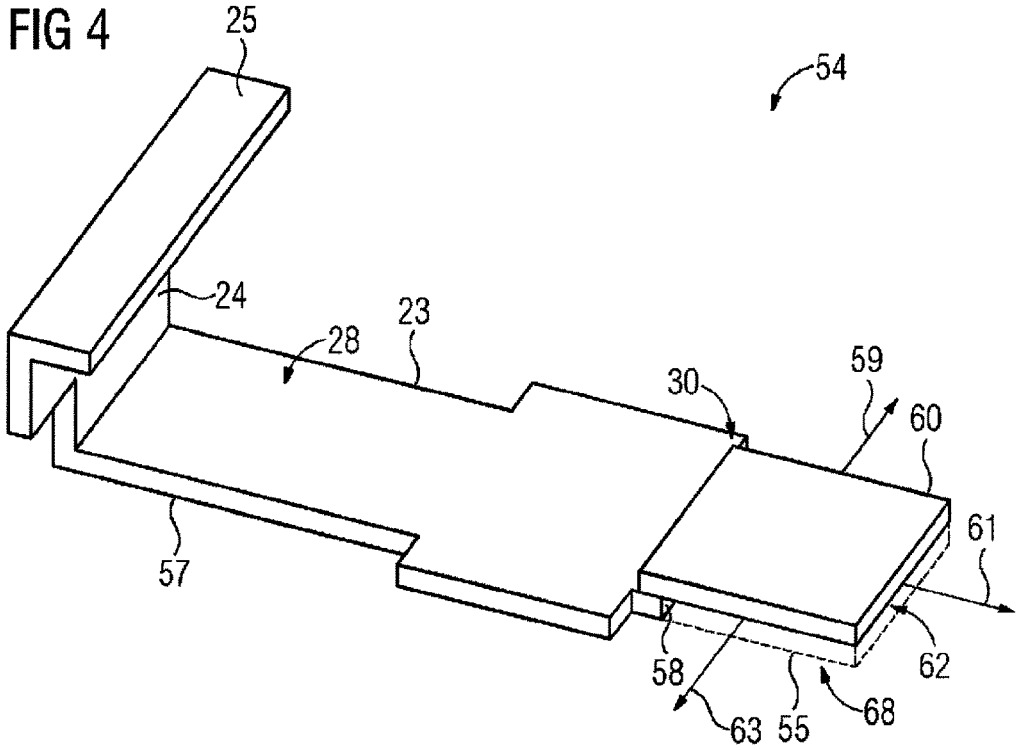
FIG. 4 shows a perspective, schematic view of a retaining element according to a second exemplary embodiment of the invention.

FIG. 4 shows a retaining element 54 according to the invention according to a second exemplary embodiment. The retaining element 54 differs from the retaining element shown in FIG. 2 by a different design of the cooling air passage 55. The fastening section 23 in this case comprises an elongate baseplate 57, adjoining one end face of which is the retaining section 24 and on the other end face 58 of which is arranged a blocking plate 60 which is offset in relation to the baseplate 57 in the direction of the heat shield tile (not shown). As a result, a step-like projection 30 is formed in the upper side of the fastening section 23 and the fastening section 23 extends in a step-like offset manner. The cooling air passage 55 is delimited by the underside of the blocking plate 60 and the end face 58 of the baseplate 57 which extends beneath the blocking plate. The cooling air passage 55 therefore comprises a discharge opening 62 which is arranged in the lateral faces of the fastening section 23 and circumferentially extends around the end of said fastening section 23. An outflow direction 59, 61, 63 is impressed upon the cooling air flow when passing through the cooling air passage 55 and extends parallel to the cold side of a heat shield tile which is retained by the retaining section.

Figure 5:
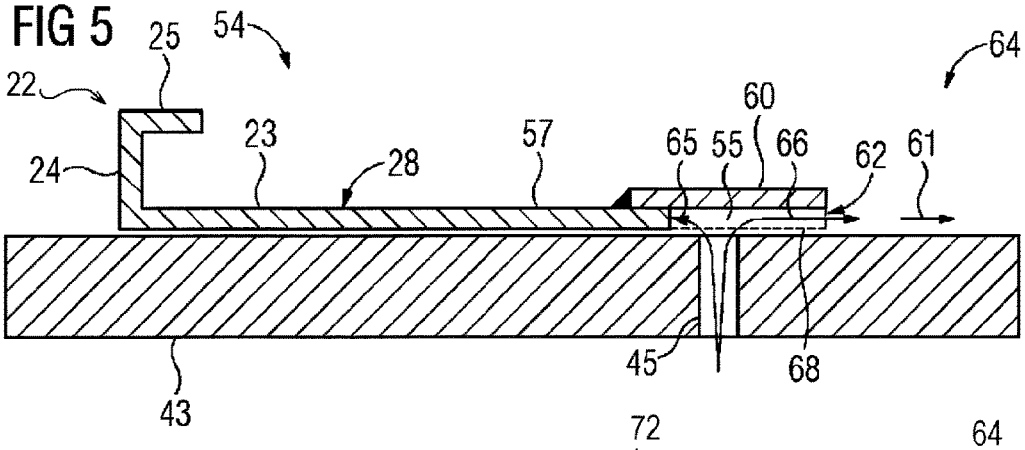
FIG. 5 shows a sectional view of the retaining element shown in FIG. 4 arranged on a support structure of a heat shield according to the invention.

FIGS. 5 and 6 show a detail of a heat shield 64 according to the invention with a support structure 43 and a retaining element 22, 54, fastened on the support structure, which is designed according to FIG. 4. The retaining element retains a respective one of a plurality of heat shield tiles 22. The heat shield tile includes a peripheral retention groove 73 on at least two sides and the retaining head 25 extends into the groove 73 to retain the tile 72.

The fastening section 23, including the baseplate 57 and the blocking plate 60, is fastened on the support structure 43 in such a way that a cooling air channel 45 communicates with the cooling air passage 55. By means of the cooling air passage 55, outflow directions 59, 61, 63 are impressed upon the cooling air which flows from the cooling air channel 45 along the exemplarily sketched-in flow paths 65 and 66 into the inlet opening 68 of the cooling air passage 55 and out of the discharge opening 62. The outflow direction in the depicted exemplary embodiment points parallel to the cold side 71 of a heat shield tile 72 which is retained by the retaining section 24. The depicted exemplary embodiment is particularly well suited for cooling the edges of a fastening groove (not shown) in which the retaining element 54 is fastened on the support structure.

Within the scope of the invention, a direction which is parallel to the cold side of the heat shield tile is synonymous with a direction which is parallel to the surface of the support structure facing the heat shield tile. Surface irregularities of the support structure are not taken into consideration in this case.

The invention claimed is:

1. A retaining element for retaining a heat shield tile on a support structure of a gas turbine engine component, the retaining element comprising:

the support structure of the gas turbine engine component, a fastening section configured to be fastened on the support structure in a fastening groove, the fastening section comprises at least one tile retaining section with a retaining head configured for engaging the heat shield tile, the fastening section further comprises an elongated baseplate, the at least one tile retaining section is arranged toward one end of the elongated baseplate, and the fastening section having an adjoining end region facing away from the at least one tile retaining section, and an upper side of the fastening section located to face a cold side of the heat shield tile;

the fastening section in the adjoining end region on the upper side of the fastening section comprises a projection, and the projection projects from the elongated baseplate in a direction perpendicular to a surface of the support structure towards the heat shield tile and away from the at least one tile retaining section;

at least one cooling air passage arranged in the fastening section in a region of the projection, the at least one cooling air passage comprising an inlet opening communicating into at least one discharge opening which is arranged in at least one of a lateral face of and at the upper side of the fastening section;

the at least one cooling air passage configured for supplying cooling air flow in an outflow direction and the cooling air flow flows through the at least one discharge opening, wherein the outflow direction comprises a velocity component which is parallel to the cold side of the tile and avoids impingement cooling of the heat shield tile wherein the heat shield is retained by the at least one tile retaining section; and the fastening section is arranged on the support structure of the gas turbine component such that the inlet opening of the at least one cooling air passage aligns with a cooling air channel in a bottom of the fastening groove.

2. The retaining element as claimed in claim 1, further comprising the fastening section extends in a step-like offset manner in the region of the projection.

3. The retaining element as claimed in claim 1, wherein the at least one cooling air passage comprises a cooling air hole, arranged in the fastening section, and comprises the at least one discharge opening which is arranged in at least one lateral face of the projection.

4. The retaining element as claimed in claim 3, further comprising the projection is stepped with the lateral face pointing in the direction of the at least one tile retaining section, and the at least one discharge opening arranged in the lateral face.

5. The retaining element as claimed in claim 3, wherein the end region includes a blocking plate in a stepped offset manner on the baseplate defining the projection as stepped by means of the blocking plate in the upper side of the fastening section, wherein the at least one cooling air passage is defined at least by an underside of the blocking plate and a portion of an end face of the baseplate which extends beneath the blocking plate.

6. A heat shield for a combustion chamber of a gas turbine comprising:

a support structure of a gas turbine component, for supporting a plurality of heat shield tiles to be detachably fastened on the support structure of the gas turbine component with retaining elements, wherein each heat shield tile of the plurality of heat shield tiles has a cold side facing the support structure of the gas turbine component and a hot side opposite the cold side that is acted upon by a hot medium;

each retaining element of the retaining elements has a retaining section configured for fastening on one of the plurality of heat shield tiles and has a fastening section configured for being fastened on the support structure of the gas turbine component in a fastening groove, at least one cooling air channel is provided in the support structure of the gas turbine component for protection against hot gases;

at least one retaining element of the retaining elements is the retaining element as claimed in claim 1; and wherein the at least one cooling air channel in the support structure of the gas turbine component is communicating with the retaining element such that with the plurality of heat shield tiles fastened on the support structure of the gas turbine component, cooling air flowing from the cooling air channel at least partially enters the inlet opening of the at least one cooling air passage.

7. A combustion chamber which is lined with a heat shield, as claimed in claim 6.

8. A gas turbine with a combustion chamber as claimed in claim 7.

9. A method for cooling a support structure of a gas turbine heat shield comprised of a plurality of heat shield tiles; the method comprising:

detachably fastening the heat shield tiles on the support structure of a gas turbine heat shield with retaining elements and guiding at least one retaining element of the retaining elements by a fastening section in a fastening groove extending in the support structure; and wherein the at least one retaining element of the retaining elements is the retaining element as claimed in claim 1, and is positioned in the fastening groove in such a way that the inlet opening of the at least one cooling air passage which is arranged in the fastening section and the at least one discharge opening of the cooling air channel which is arranged in a bottom of the groove align with each other so that cooling air discharging from the the at least one discharge opening of the cooling air channel is directed at least partially from the support structure of a gas turbine heat shield along the at least one cooling air passage formed by the fastening section of the retaining element to at least the upper side and/or the lateral face of the fastening section and configured to impress a flow direction upon the cooling air by means of the at least one cooling air passage, wherein the impressed flow direction is selected to avoid impingement cooling of the heat shield tile.

10. The method as claimed in claim 9, further comprising directing the cooling air being discharged from the at least one cooling air passage onto at least one region of the support structure of a gas turbine heat shield on which a fastening section of a retaining element is fastened.

11. The method as claimed in claim 10, further comprising directing the cooling air flowing along the at least one cooling air passage onto an edge of the fastening groove.

12. A retaining element for retaining a heat shield tile on a support structure of a gas turbine engine component, the retaining element comprising:

the support structure of the gas turbine engine component a fastening section configured to be fastened on the support structure, the fastening section comprises at least one tile retaining section with a retaining head configured for engaging the heat shield tile;

an upper side of the fastening section located to face a cold side of the heat shield tile;

the fastening section further comprises an elongate baseplate, the at least one tile retaining section is arranged toward one end of the baseplate;

the upper side of the fastening section comprises a projection and the projection projects from the base plate in a direction perpendicular to a surface of the support structure of the gas turbine engine component towards the heat shield tile and away from the at least one tile retaining section;

at least one discharge opening directed laterally from the fastening section for flowing of cooling air flow;

at least one cooling air passage arranged in the fastening section, the at least one cooling air passage comprises an inlet opening communicating into at least one of the discharge openings directed laterally;

the at least one cooling air passage configured for supplying cooling air flow in an outflow direction and the cooling air flow is directed to be impressed upon the cooling air flow from the at least one discharge opening, wherein the outflow direction comprises a velocity component which is parallel to the cold side of the tile and avoids impingement cooling of the heat shield tile which is then retained by the at least one tile retaining section; and the fastening section is arranged on the support structure of the gas turbine engine component such that the inlet opening of the at least one cooling air passage aligns with a cooling air channel in the support structure of the gas turbine engine component.

13. A retaining element as claimed in claim 12, wherein the projection has lateral faces with the at least one discharge opening.

* * * * *